US005230974A

United States Patent [19]

Pai et al.

[11] Patent Number: 5,230,974

[45] Date of Patent: Jul. 27, 1993

[54] PHOTORECEPTOR FOR TEXTUAL AND PICTORIAL REPRODUCTIONS HAVING A NONCONTINUOUS CHARGE GENERATING LAYER

[75] Inventors: Damodar M. Pai, Fairport; Andrew R. Melnyk, Rochester, both of N.Y.

[73] Assignee: Xerox Corporation, Stamford, Conn.

[21] Appl. No.: 813,712

[22] Filed: Dec. 27, 1991

[51] Int. Cl.[5] ..... G03G 5/043

[52] U.S. Cl. ..... 430/54; 430/58; 430/126

[58] Field of Search ..... 430/57, 60, 63, 86, 430/54, 58, 126

[56] References Cited

U.S. PATENT DOCUMENTS 4,175,957 11/1979 Sato ..... 430/31
4,415,639 11/1983 Horgan ..... 430/57
4,490,451 12/1984 Baumgaertner et al. ..... 430/57
4,587,193 5/1986 Everhardus et al. ..... 430/126
4,672,015 6/1987 Maruyama et al. ..... 430/95
4,734,346 3/1988 Kumano et al. ..... 430/56
4,803,141 2/1989 Yoshizawa et al. ..... 430/58
4,885,226 12/1989 Takeuchi et al. ..... 430/65

*Primary Examiner*—John Goodrow
*Attorney, Agent, or Firm*—Kenyon & Kenyon

[57] ABSTRACT

An electrophotographic imaging member includes two charge generator layers and a charge transport layer. The first charge generator layer is fabricated in the form of a dot or line pattern and is sensitive to a wavelength region to which the second continuous generator layer is both transparent and insensitive. This imaging member may be employed in an electrophotographic imaging process to produce textual or pictorial reproduction on demand.

35 Claims, 1 Drawing Sheet

PHOTORECEPTOR FOR TEXTUAL AND PICTORIAL REPRODUCTIONS HAVING A NONCONTINUOUS CHARGE GENERATING LAYER

BACKGROUND OF THE INVENTION

This invention relates in general to electrophotographic imaging members and more specifically, to imaging members having optimum characteristics for reproduction of both textual and pictorial images.

Electrophotographic photoreceptors typically include a photoconductive layer formed on a conductive substrate. The photoconductive layer has a very large dark resistivity so that electric charges can be retained on its surface. Additionally, the dark resistivity can be reduced by several orders of magnitude upon exposure to light.

A latent image is formed on the photoreceptor by first depositing electric charges over the surface of the photoconductive layer by one of any means known in the art. An image is then projected onto the photoconductive layer. On those portions of the surface of the photoconductive layer that are exposed to light, the electric charge is conducted away from the surface. The portions of the photoconductive surface not exposed to light retain their surface charge. The quantity of electric charge at any particular area of the photoconductive surface is inversely proportional to the illumination incident thereon, thus forming a latent electrophotographic image.

One common type of photoreceptor is a multilayered device that comprises a conductive layer, a charge blocking layer, an adhesive layer, a charge generator layer, and a charge transport layer. The charge transport layer can contain an active aromatic diamine small molecule, which enables charge transport, dissolved or molecularly dispersed in a film forming binder. This type of charge transport layer is described, for example in U.S. Pat. No. 4,265,990. Other charge transport molecules disclosed in the prior art include a variety of electron donor aromatic amines oxadiazoles, oxazoles, hydrazones and stilbenes for hole transport and electron acceptor molecules for electron transport.

Another type of charge transport layer has been developed which utilizes a charge transporting polymer. This type of charge transport polymer includes materials such a poly N-vinyl carbazole, polysillenes, and others, including those described in U.S. Pat. Nos. 4,618,551, 4,806,443, 4,806,444, 4,818,650, 4,935,487, 4,956,440.

Charge generator layers employed include amorphous films of selenium and arsenic and organic pigments such as quinacridones, polycyclic pigments such as dibromo anthanthrone pigments, perylene and perinone diamenes, substituted 2,4-diaminotriazines disclosed in U.S. Pat. No. 3,442,781, polynuclear aromatic quinones, bisazo pigments, and the like dispersed in a film forming polymeric binder or a binderless film fabricated by solvent or vacuum sublimation.

Pthalocyanines have been employed as photogenerator materials for use in both visible and infrared exposure machines. Infrared sensitivity is a requirement if semiconductor lasers are employed as the exposure source. The absorption spectrum and photosensitivity depend on the central metal atom. Many metal pthalocyanines have been reported. These include oxyvanadium pthalocyanine, chloroaluminum pthalocyanine, copper pthalocyanine, oxytitanium pthalocyanine, chlorogallium pthalocyanine, magnesium pthalocyanine and metal-free pthalocyanine. Some of these pthalocyanines exist in many crystal forms.

A latent image is formed by first charging the photoconductive device to the appropriate polarity (i.e., negative if the transport layer is hole transporting and positive if the transport layer is electron transporting) followed by imagewise exposure with visible or infrared light. The transport layer is transparent to these radiations. The exposure light photons are absorbed by the pigment in the generator layer. Photogenerated holes are injected into the transport layer, if the transporting moiety is a donor type. The injected holes traverse the transport layer and discharge the exposed regions. If the transporting moiety in the transport layer is acceptor type, the device is charged to a positive polarity. The photogenerated electrons during the exposure step are injected from the pigment into the transport layer and are transported across the transport layer to discharge the device. A charged latent image replicating the original is thus formed. A developed image is formed by electrically attracting fine particles to the latent image on the surface of the photoconductive plate.

A latent image consisting of a narrow dark line, such as results from an image of text, produces a sharp electrostatic border on the photoconductive surface in which a small region of electrostatic charge is adjacent to a region depleted of surface charge. At these electrostatic borders the resultant external electric fringing fields are relatively high. Hence, a dark, solid, developed image is produced at these border regions. However, the external fringing field will be relatively small above any of the photoconductive surface that contains a uniform electric charge. Therefore, if the latent image consists of a large dark area rather than a narrow dark line or region, the external electric fringing fields in a central region of the dark area will be small. Only near the border between the dark area and a light area will the external fringing fields be high. As a consequence of this characteristic of the external fringing field, a developed image that includes large black regions will appear black only near the edges while the more central regions of the black area will appear washed out. This shortcoming of the process is corrected by the introduction of a biased development electrode which increases the development field in the central regions of solid areas.

Even with the introduction of a development electrode, the conventional xerographic process, without added features, is only suitable for reproduction of textual materials in which the range of output densities is very narrow. The characteristic that determines the range of the output densities is the tone reproduction curve which is a plot of the original document (input) densities ($D_{in}$) versus the copy (output) densities ($D_{out}$). These are represented in a tone reproduction curve, which is a graph of $D_{in}$ versus $D_{out}$. In silver halide photography, the tone reproduction curve has a toe for very low densities followed by a linear region in mid densities and a saturation of $D_{out}$ at high $D_{in}$. The slope of the curve $D_{out}/D_{in}$ in the mid-densities is approximately 1.4. The range of input densities that the silver halide film can image is high. This type of $D_{in}$-$D_{out}$ characteristic is well suited for imaging originals containing pictorial content because of the large range of densities that can be reproduced. The tone reproduction curve of conventional solid area xerography, on the other hand, has no toe at low densities (zero output densities at very low input densities) and a range of 0.6 before saturation sets in. A pictorial reproduction on a system with this kind of tone reproduction curve results in wash out of very low density regions and very dark output in mid-density region inputs.

Electrophotographic process characteristics that adversely impact pictorial reproductions are reviewed by R. N. Goren in the article titled, "Problems of Pictorial Xerography", published in *Journal of Applied Photographic Engineering*, 2, pp. 17-17, 1976. Although the xerographic process consists of several steps (charging, exposing, developing, transferring and fixing). The high contrast, narrow output range characteristics arise mainly from the characteristic responses called transfer functions, of mainly two of the process steps. The first is the transfer function of the photoreceptor and the second is the transfer function of the toner development.

The transfer function of the photoreceptor subsystem, generally called the Photoinduced Discharge Curve (PIDC), is a plot of the surface potential of the photoreceptor as a function of the incident light exposure. The shape of this discharge curve depends on multiple factors such as the field dependence (if any) of the photogeneration processes in the pigment, the field dependence of the efficiency of charge injection from the pigment into the transport layer and the range (distance per unit field) of the charge carriers in the transport layer. In most practical photoreceptors, the PIDC is approximately linear with light exposure except at low voltages (high light exposures), where the field dependent mechanisms listed above decrease the rate of discharge.

The transfer function of the development subsystem, called the development function, is the developed toner density as a function of the photoreceptor potential. The developed toner mass per unit area varies linearly with the electric field that drives the development step. This electrical field is proportional to the difference between the photoreceptor surface potential and the bias voltage on the development electrode. For example, in magnetic brush development, bias voltage is applied to the development roll.

The density reproduction curve is obtained by combining the PIDC and the development transfer functions. Since both of these transfer functions are approximately linear, they transform the log of light exposure, which is proportional to the image density, to log image density, thereby narrowing the density reproduction range. Several approaches have been attempted to increase this range.

One approach is to change the shape of the PIDC so that it is logarithmic rather than linear with light exposure. U.S. Pat. No. 3,764,315 to J. Mort et al. discloses an extended signal layer photoconductor containing a cadmium-sulfo-selenide binder plate with a dynamic range of 2. The discharge shape of this photoconductor is not optimized for reproducing textual material.

Another known technique for improving tone reproduction characteristics is with the use of halftone screening methods. This is a well known method in graphic arts that produces an image density by varying the size of a dot at a fixed spatial frequency.

A simple means for obtaining a half tone screening method is accomplished by placing a printed screen comprising a black and white dot pattern on a transparent material between the original document and the photoreceptor. The screen reflects light to the photoreceptor with a modulated intensity pattern that corresponds to the dot pattern. Alternatively, the screen can be introduced by sequentially exposing to the original document and a black and white dot pattern. Still another method of obtaining a halftone screen is by pre-exposing the photoreceptor with light transmitted through the screen before exposure with light from the image, a modulated charge density is imparted to the photoreceptor, thus extending the exposure range of the electrophotographic process by the halftone screening method. Such transmission modulation screens are disclosed by R. N. Goren and L. M. Marks in "Document Screens for Extended Range Electrophotography", *Photogr. Sci. Eng.* 18, pp. 605-609 (1974).

Another halftone screen technique for obtaining pictorial image reproduction is disclosed by W. Hope and M. Levy in J. H. Dessauer and H. E. Clark, *Xerography and Related Processes*, Focal Press, London, 1965, P. 113. Their photoreceptor comprises a transparent substrate on which an optically screened plate is placed. A transparent electrode and a photoconductor are formed over the plate. When a high gamma response is desired, uniform illumination is first projected from below the photoreceptor through the transparent substrate and through the optical screen to generate a modulated charge intensity on the photoconductor surface. After this pre-exposure step the image is exposed onto the front of the photoreceptor in a conventional manner. Although this photoreceptor disclosed by Hope and Levy can provide both a high gamma and an low gamma response, it requires a transparent substrate. Hence, this photoreceptor can only be used in a limited range of configurations. In particular, it cannot be used on aluminum drums.

Similar inactive screens are disclosed in U.S. Pat. No. 4,495,263, issued to P. D. Vander Valk. This patent discloses an electrophotographic element containing an inactive integral screen between a conductive substrate and polyamide interface layer. Although this photoreceptor can provide both a high gamma and a low gamma response, it too requires a transparent substrate and hence, can only be used in a limited range of configurations.

Other known photoreceptors include a variety of organic photoconductors containing two generator layers to extend the spectral response. Both generator layers however, are continuous and do not lend themselves to use in both high contrast and extended range reproductions.

SUMMARY OF THE INVENTION

It is, therefore, an object of the present invention to provide an improved electrophotographic imaging member which overcomes the above-noted disadvantages.

It is another object of the present invention to provide an electrophotographic imaging member which enables both a high density contrast and low density contrast to reproduce both textual and pictorial originals on demand.

It is still another object of the present invention to provide an electrophotographic imaging member exhibiting high gamma and low gamma response to reproduce both textual and pictorial originals on demand on both transparent and opaque substrates.

It is still another object of the present invention to provide an electrophotographic imaging member and a process exhibiting high density contrast and low density contrast response simultaneously to reproduce an original containing both textual and pictorial originals.

The foregoing objects and others are accomplished in accordance with this invention by providing an electrophotographic imaging member comprising two generator layers and a charge transport layer. The first generator layer is fabricated as an unconnected series of photoconductive regions that form a dot or a line pattern of the type employed for the fabrication of half tone plates in newspaper printing. The dots or lines may be of any shape and pattern, and may be regular or random. Particularly useful are dot or line densities of 100–150 dots or lines per inch. The second generator layer is continuous. The first generator material employed in the first layer includes materials that respond to wavelengths that the second generator is insensitive to. For example, the first layer may respond only to infrared light while the second layer absorbs only the visible and hence is insensitive to the infrared region of the spectrum. The charge transport layer comprises either a charge transporting molecular dispersion in a inert binder or a charge transporting polymer in which the charge is transported through the active moieties incorporated in the backbone.

In an alternative embodiment of the invention, the first charge generator layer is continuous and the second charge generator layer is noncontinuous. In this embodiment, the second generator layer includes materials that respond to wavelengths that the first generator layer is insensitive to.

Electrophotographic imaging members are well known in the art and may be prepared by a variety of techniques. Typically, a flexible or rigid substrate is provided having an electrically conductive surface. A charge generator layer is then applied to the electrically conductive surface. A charge blocking layer may be applied to the electrically conductive surface prior to the application of the charge generator layer. If desired, an adhesive layer may be utilized between the charge blocking layer and the charge generator layer. Usually, the charge generator layer is applied onto the blocking layer and a charge transport layer is formed on the charge generator layer.

The substrate may be opaque or substantially transparent and may comprise numerous suitable materials having the required mechanical properties. Accordingly, the substrate may comprise a layer of an electrically non-conductive or conductive material that has an inorganic or an organic composition. Electrically nonconducting materials that may be employed include various resins known for this purpose, including polyesters, polycarbonates, polyamides, polyurethanes, and the like, which are flexible as thin webs. The electrically insulating or conductive substrate may be in the form of an endless flexible belt, a web, a rigid cylinder, a sheet or the like.

The thickness of the substrate layer depends on numerous factors, including the strength desired as well as economical considerations. Thus, this layer for a drum may be of substantial thickness, up to centimeters for example, or of minimum thickness less than a millimeter. Similarly, a flexible belt may be of substantial thickness, for example, about 250 micrometers, or of minimum thickness less than 50 micrometers, provided there are no adverse effects on the final electrophotographic device. The surface of the substrate layer is preferably cleaned prior to coating to promote greater adhesion of the deposited coating. Cleaning may be accomplished, for example, by exposing the surface of the substrate layer to plasma discharge, ion bombardment and the like.

In case the substrate layer is not conductive, a separate electrically conductive layer is required. The conductive layer may vary in thickness over substantially wide ranges depending on the optical transparency and degree of flexibility desired for the electrophotographic member. Accordingly, for a flexible photoresponsive imaging device, the thickness of the conductive layer may be between about 20 angstroms to about 750 angstroms, and more preferably from about 100 angstroms to about 200 angstroms for an optimum combination of electrical conductivity, flexibility and light transmission.

The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate, e.g., a polyester web substrate such as MYLAR available from E. I. du Pont de Nemours & Co. with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. A typical electrical conductivity for conductive layers for electrophotographic imaging members in slow speed copiers is about $10^2$ to $10^3$ ohms/square.

After the formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. For negatively charged photoreceptors, the blocking layer has to prevent injection of holes from the ground plane. Any suitable blocking layer capable of forming an electronic barrier to holes between the adjacent photoconductive layer and the underlying conductive layer may be utilized. The blocking layer may be inorganic such as metal oxides or organic such as nitrogen-containing siloxanes or nitrogen-containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzens sulfonyl, di(dodecylbenzene sulfonyl) titanate, isopropyl di(4-aminobenzoyl)isostearoyl titanate, isopropyl tri(N,N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl) methyl diethoxysilane, $[H_2N(CH_2)_4]CH_3Si(OCH_3)_2$, and (gamma-aminopropyl) methyl diethoxysilane, $[H_2N(CH_2)_3]CH_3Si(OCH_3)_2$ as disclosed in U.S. Pat. Nos. 4,338,387, 4,286,033 and 4,291,110. The disclosures of U.S. Pat. Nos. 4,338,387, 4,286,033 and 4,291,110 are incorporated herein by reference. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and have a thickness of less than about 0.2 micrometer because greater thicknesses may lead to an undesirably high residual voltage.

An optional adhesive layer may be applied to the hole blocking layer. Any suitable adhesive layer well known in the art may be utilized. Typical adhesive layer materials include, for example, polyesters, DUPONT 49,000 (available from E. I. du Pont de Nemours and Company), VITEL PE100 (available from Goodyear Tire & Rubber), polyurethanes, and the like. Satisfactory results may be achieved with adhesive layer thicknesses between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating and the like. Drying of the deposited coating may be effected by any suitable conventional technique such as oven drying, infrared radiation drying, air drying and the like.

Any suitable first photogenerator layer may be applied to the adhesive or blocking layer. The screen type of structure of the first generator layer can be fabricated by any suitable technique such as offset, gravure printing, ink jet printing or by employing suitable masks in case the first generator layer is vacuum sublimed. Examples of typical photogenerator layers include inorganic photoconductive films which are sensitive in the infrared region such as amorphous alloys of selenium and tellurium and organic photoconductive pigments including various phthalocyanine pigments, such as the X-form of metal free phthalocyanine described in U.S. Pat. No. 3,357,989, metal phthalocyanines, such as vanadyl phthalocyanine and copper phthalocyanine, oxititanium pthalocyanines, squarylium and bis azo pigments and the like dispersed in a film forming polymeric binder or a binderless film fabricated by vacuum sublimation. The second continuous generator layer could include amorphous films of selenium and arsenic and organic pigments such as quinacridones available from du Pont under the tradename MONASTRAL RED, MONASTRAL VIOLET and MONASTRAL RED Y, VAT ORANGE 1 and VAT ORANGE 3, trade names for various dibromo anthanthrone pigments, benzimidazole perylene, substituted 2,4-diaminotriazines disclosed in U.S. Pat. No. 3,442,781, polynuclear aromatic quinones available for Allied Chemical Corporation under the tradenames INDOFAST DOUBLE SCARLET, INDOFAST VIOLET LAKE B, INDOFAST BRILLIANT SCARLET and INDOFAST ORANGE, and the like dispersed in a film forming polymeric binder or a binderless film fabricated by vacuum sublimation. Other suitable photogenerator materials known in the art may also be utilized, provided the selection of materials in the two layers meets the criterion that the first generator layer be sensitive to wavelengths that the material in the second generator layer is transparent to.

Any suitable polymeric film forming binder material may be employed as the matrix in the photogenerator binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyurethanes, polystyrenes, polyarylethers, polyarylsulfones, polybutadienes, polysulfones, polyethersulfones, polyethylenes, polypropylenes, polymethylpentenes, polyphenylene sulfides, polyvinyl acetates, polysiloxanes, polyacrylates, polyvinyl acetals, polyamides, polyimides, amino resins, phenylene oxide resins, terephthalic acid resins, phenoxyresins, epoxy resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, polyvinylchloride, vinylchloride and vinyl acetate copolymers, acrylate copolymers, alkyd resins, cellulisic film formers, poly(amideimide), styrenebutadiene copolymers, vinylidenechloridevinylchloride copolymers, vinylacetatevinylidenechloride copolymers, styrene-alkyd resins, polyvinylcarbazole, and the like. These polymers may be block, random or alternating copolymers. The photogenerator composition or pigment is present in the resinous binder composition in various amounts. Generally, however, from about 5 percent by volume to about 90 percent by volume of the photogenerator pigment is dispersed in about 95 percent by volume to about 10 percent by volume of the resinous binder, and preferably from about 20 percent by volume to about 30 percent by volume of the photogenerator pigment is dispersed in about 80 percent by volume to about 70 percent by volume of the resinous binder composition. The photogenerator layers can also be fabricated by vacuum sublimation in which case there is no binder.

The two photogenerator layers containing photoconductive compositions and/or pigments and the resinous binder material generally range in thickness from about 0.1 micrometer to about 5.0 micrometers, and preferably have a thickness of from about 0.1 micrometer to about 3 micrometers. The photogenerator layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerator layer coating mixture. Typical application techniques include spraying, dip coating, roll coating, wire wound rod coating, vacuum sublimation and the like. The first generator layer has to be fabricated in a dot or line pattern. Removing the solvent of a solvent coated layer may be effected by any suitable conventional technique such as oven drying, infrared radiation drying, air drying and the like.

The dual generator layers are overcoated with a charge transport layer. The charge transport layer comprises a charge transporting small molecule dissolved or molecularly dispersed in a film forming inert polymer such as polycarbonate. The charge transport layer may also be fabricated from a charge transporting polymer comprising charge transporting moieties in the backbone of the film forming charge transporting polymer. Any suitable charge transporting or electrically active small molecule may be employed in the charge transport layer of this invention. Typical charge transporting small molecules include, for example, pyrazolines such as 1-phenyl-3(4'-diethylamino styryl)-5-(4''-diethylamino pyrazoline, diamines such as N,N'-diphenyl-N,N'-phenyl) bis(3-methylphenyl)-(1,1'-biphenyl)-4,4'-diamine, hydrazones such as N-phenyl-N-methyl-3-(9-ethyl) carbazyl hydrazone and 4, diethyl amino benzaldehyde-1,2 diphenyl hydrazone and oxidiazoles such as 2,5-bis (4-N,N' diethylaminophenyl)-1,2,4-oxadiazole, triphenyl methanes such as bis(4,N,N-diethylamino-2-methyl phenyl)-phenyl methane, stilbenes and the like. These electrically active small molecule charge transporting compounds are dissolved or molecularly dispersed in electrically inactive polymeric materials. Any suitable and conventional technique may be utilized to mix and thereafter apply the charge transport layer coating mixture to the charge generator layer. Typical application techniques include spraying, dip coating, roll coating, wire wound rod coating, and the like. Drying of the deposited coating may be effected by any suitable conventional technique such as oven drying, infrared radiation drying, air drying and the like.

Generally, the thickness of the hole transport layer is between about 10 micrometers to about 50 micrometers, but thicknesses outside this range can also be used. The hole transport layer should be an insulator to the extent that the electrostatic charge placed on the hole transport layer is not conducted in the absence of illumination at a rate sufficient to prevent later formation and retention of an electrostatic latent image thereon. In general, the ratio of the thickness of the hole transport layer to the charge generator layers is preferably maintained from about 2:1 to 200:1 and in some instances is as great as 400:1. In other words, the charge transport layer is substantially non-absorbing to visible light or radiation in the region of intended use but is "active" in that it allows the injection of photogenerated holes from the photoconductive layer, i.e., charge generator layer, and allows these holes to be transported through the active charge transport layer to selectively discharge a surface charge on the surface of the active layer. Other layers may also be used such as a conventional electrically conductive ground strip along one edge of the belt or drum in contact with the conductive layer, blocking layer, adhesive layer or charge generator layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to improve resistance to abrasion. In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers.

DETAILED DESCRIPTION

Figure 1:
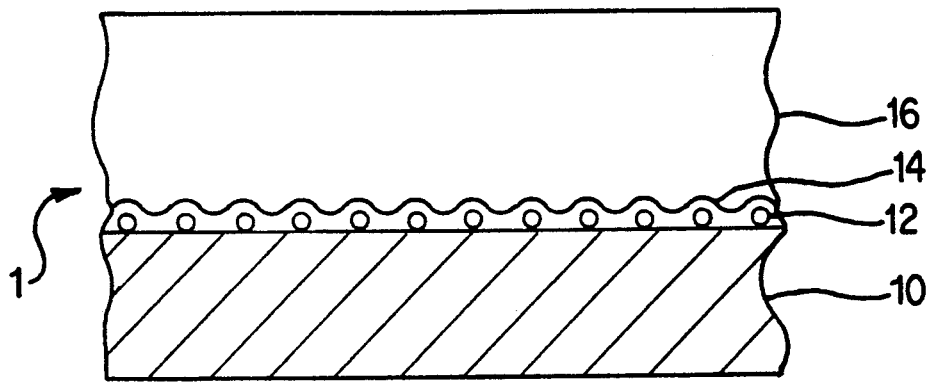
FIG. 1 shows a schematic, cross-sectional view of an electrophotographic photoreceptor constructed according to the principles of the invention.

FIG. 1 schematically illustrates an electrophotographic photoreceptor 1 that includes a conductive substrate 10, a first charge generator layer 12 that contacts the substrate 10, and a second charge generator layer 14 formed on the first generator layer 12. As FIG. 1 shows, the first charge generator layer 12 is not continuous, but rather is fabricated as an unconnected series of photoconductive regions that form a pattern of any type, such as a dot or line pattern. The second charge generator layer 14 is continuous. The transport layer is designated by reference numeral 16.

The first charge generator layer 12 includes a generator material or pigment that responds to a waveband of light to which the second generator layer 14 is insensitive. For example, the first layer 12 may respond only to infrared light while the second layer 14 may respond only to visible light and hence is insensitive to the infrared region.

Figure 2:
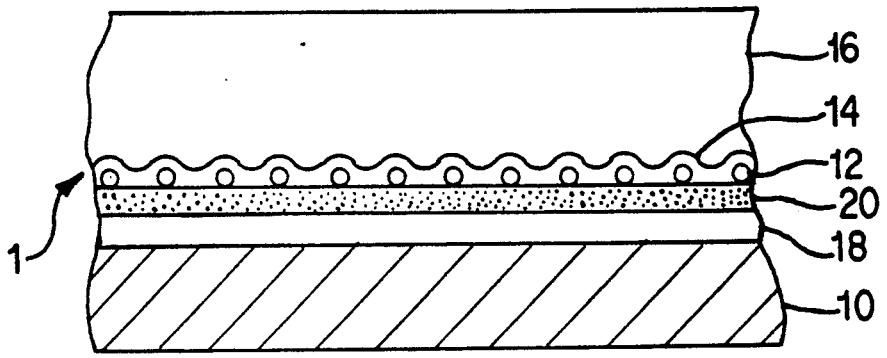
FIG. 2 shows a schematic, cross-sectional view of an alternative embodiment of the electrophotographic photoreceptor of the present invention.

FIG. 2 schematically illustrates an electrophotographic photoreceptor 1 that includes a conductive substrate 10, a barrier layer 18, adhesive layer 20, a first charge generator layer 12 that contacts the adhesive layer 20, and a second charge generator layer 14 formed on the first generator layer 12. Similar to the embodiment of the invention shown in FIG. 1, the first charge generator layer 12 of the embodiment shown in FIG. 2 is not continuous, but rather is fabricated as an unconnected series of photoconductive regions that form a pattern of any type, such as a dot or line pattern. The second charge generator layer 14 is continuous.

Figure 3:
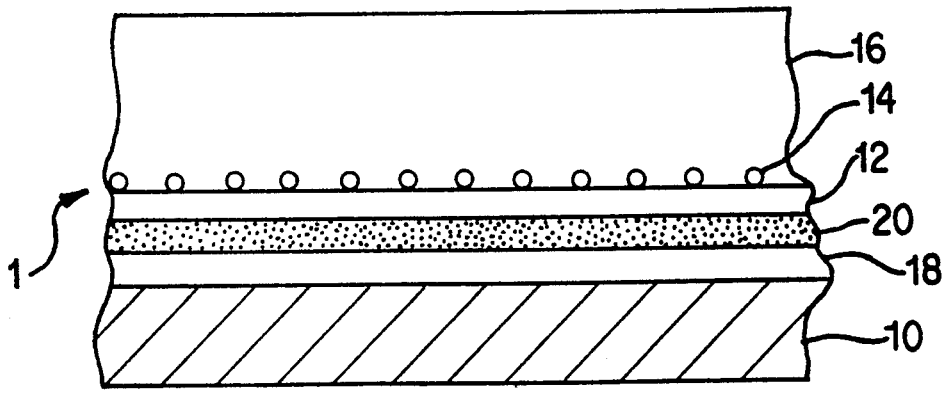
FIG. 3 shows a schematic, cross-sectional view of another alternative embodiment of the electrophotographic photoreceptor of the present invention.

FIG. 3 schematically illustrates an electrophotographic photoreceptor 1 similar to the photoreceptor of FIG. 2 except that the first charge generator layer 12 is continuous and the second charge generator layer 14 is not continuous.

The photoreceptor 1 can produce both a high and a low contrast without the need for illuminating it from below and thus it does not require a transparent substrate. The high contrast or text reproduction response is produced by charging the photoreceptor 1 in a conventional manner and then projecting the desired image onto the front of the photoreceptor 1 with visible light. In this case only the second generator layer 14 responds, producing a latent image with the conventional high gamma response.

The low contrast or pictorial reproduction response is produced in a two-step exposure process on the desired portions of the image. After charging the photoreceptor 1, uniform intensity light to which only the first generator layer 12 is sensitive is projected onto the front of the photoreceptor 1. In the second step of the exposure process, the desired image is projected through the front of the photoreceptor 1 with visible light, forming a latent image as in the high contrast process, but superimposed on the modulated charge pattern, thus producing a half tone image with a low contrast response. The size and density of each region of the modulated charge pattern can be optimized by varying the intensity of the infrared illumination to the screen (i.e., the first generator layer 12). By using a segmented or patterned infrared exposure and a method whereby the operator specifies the portion of a document to be reproduced in a pictorial mode, the two methods can be used simultaneously with one original.

Although the photoreceptor of the present invention does not require a transparent substrate, the photoreceptor may nevertheless be fabricated on transparent flexible substrates. In such a case, the infrared exposure used to produce the dot or line pattern can be incident from the front or the rear of the photoreceptor.

Examples of the photoreceptor of the present invention are set forth herein below and are illustrative of the different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE 1

A photoreceptor is prepared by forming coatings using conventional techniques on a substrate comprising a vacuum deposited titanium layer on a polyethylene terephthalate film (MELINEX, available from E. I. du Pont de Nemours & Co.). The first deposited coating is a siloxane barrier layer formed from hydrolyzed gamma aminopropyltriethoxysilane having a thickness of 100 angstroms. The second coating is an adhesive layer of polyester resin (49,000 available from E. I. du Pont de Nemours & Co.) having a thickness of 50 angstroms. The next coating is a first charge generator layer containing 35 per cent by weight vandyl pthalocyanine particles dispersed in a polyester resin (VITEL PE100, available from Goodyear Tire and Rubber Co.) having a thickness of 1 micrometer and coated in a dot or line pattern of 200 dots or lines per inch with a percent opaque area of 50 per cent and is coated by gravure coating. The first generator layer is sensitive in the infrared. The next coating is a second charge generator layer and is coated from a solution containing 50 per cent by weight trigonal selenium having a particle size of about 0.05 micrometer to 0.2 micrometer and about 0.8 gram poly(N-vinyl carbazole) in about a 1:1 mixture of tetrahydrofuran and toluene. A 1.5 micrometer thick generator layer is coated and is dried at 135° C. in a forced air oven for 10 minutes. The last coating is a charge transport layer and is coated with a solution containing 50 per cent by weight N,N'-diphenyl-N,N'-bis(3-methyl-phenyl)-(1,1'biphenyl)-4,4'-diamine and 50 per cent by weight polycarbonate resin [a poly(4,4'-isopropylidene-diphenylene) carbonate, available under the trademark MAKROLON from Farbenfabricken Bayer A.G.] dissolved in methylene chloride solvent using a Bird coating applicator. The N,N'-diphenyl-N,N'-bis(3-methyl-phenyl)-(1,1'biphenyl)-4,4'-diamine is an electrically active aromatic diamine charge transport small molecule whereas the polycarbonate resin is an electrically inactive film forming binder. N,N'-diphenyl-N,N'-bis(3-methyl-phenyl)-(1,1'biphenyl)-4,4'-diamine has the formula:

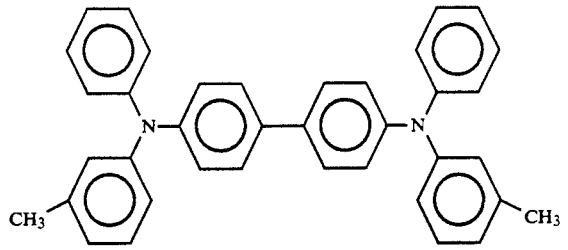

The coated device is dried at 80° C. in a forced air oven for 10 minutes to form a 20 micrometer thick charge transport layer. The device is charged to a negative polarity corona and is uniformly exposed to an infrared source to discharge the areas containing vanadyl pthalocyanine dot or lines by fifty per cent. The device is now imagewise exposed to a visible light pattern corresponding to a pictorial input image and developed. To develop an original containing textual material, the device is first charged to a negative polarity and is imagewise exposed to a visible light pattern corresponding to the original textual material and developed.

EXAMPLE 2

A photoreceptor is prepared by forming coatings using conventional techniques on a substrate comprising an aluminum drum. The aluminum drum is cleaned and an oxide layer is formed about 10 angstroms thick. The drum is wrapped with a fine wire mesh screen and the first charge generator layer containing chloroindium phthalocyanine is coated by vacuum sublimation, a dot or line pattern of 50 dot or lines per inch with a fifty per cent area coverage and an average thickness of 0.1 micrometer is formed. The first generator layer is sensitive to infrared light. The next coating is a charge generator layer of arsenic triselenide and is coated by vacuum evaporation to a thickness of 0.5 micrometer. The charge transport layer is dip coated with a solution containing 50 per cent N,N'-diphenyl-N,N'-bis(3-methyl-phenyl)-(1,1'biphenyl)-4,4'-diamine and 50 per cent polycarbonate resin [a poly(4,4'-isopropylidene-diphenylene) carbonate, available under the tradename MAKROLON® from Farbenfabricken Bayer A.G.], dissolved in methylene chloride solvent at 1:10 ration of solid to solvent. N,N'-diphenyl-N,N'-bis(3-methyl-phenyl)-(1,1'biphenyl)-4,4'diamine is an electrically active aromatic diamine charge transport small molecule and has the structure shown in Example 1. The coated device is dried at 80° C. in a forced air oven for 10 minutes to form a 20 micrometer thick charge transport layer. The device is charged to a negative polarity corona and is uniformly exposed to an infrared source to discharge by fifty percent the areas containing vanadyl pthalocyanine dot or lines. The device is then imagewise exposed to a visible light pattern corresponding to a pictorial input image and developed. To develop an original containing textual material, the device is first charged to a negative polarity and is imagewise exposed to a visible light pattern corresponding to the original textual material and developed.

What is claimed is:

1. An electrophotographic imaging member suitable for both textual and pictorial reproduction comprising:

an electrically conducting substrate;

a first noncontinuous charge generator layer disposed on said substrate, said first charge generator layer having a specifiable pattern formed in the plane of the first layer;

a second continuous charge generator layer disposed on said first charge generator layer; and a charge transport layer disposed on said second charge generator layer.

2. An electrophotographic imaging member according to claim 1 further comprising a blocking layer interposed between said substrate and said first charge generator layer.

3. An electrophotographic imaging member according to claim 2 further comprising an adhesive layer interposed between said barrier layer and said first charge generator layer.

4. An electrophotographic imaging member according to claim 3 wherein said first generator layer is sensitive to a predetermined region of the light spectrum and said second generator layer is transparent to said region of the light spectrum.

5. An imaging member according to claim 4 wherein said region of the light spectrum is in the infrared region, said second generator layer being sensitive to the visible portion of the light spectrum.

6. An electrophotographic imaging member according to claim 3 wherein said charge transport layer comprises charge transporting monomers dispersed in an inert polymer.

7. An electrophotographic imaging member according to claim 3 wherein said charge transport layer comprises a charge transporting polymer.

8. An electrophotographic imaging member according to claim 3 wherein said substrate comprises an aluminum drum.

9. An electrophotographic imaging member according to claim 3 wherein said substrate is a flexible belt having a transparent conductive coating, said substrate being transparent.

10. An electrophotographic imaging member according to claim 3 wherein the pattern of said first charge generator layer is formed by a plurality of dots.

11. An electrophotographic imaging member according to claim 3, wherein the pattern of said first charge generator layer is formed by a plurality of lines.

12. An electrophotographic imaging member suitable for both textual and pictorial reproduction comprising:

an electrically conducting substrate;

a first continuous charge generator layer disposed on said substrate;

a second noncontinuous charge generator layer disposed on said first charge generator layer, said second charge generator layer having a specifiable pattern formed in the plane of the second layer; and a charge transport layer disposed on said second charge generator layer.

13. An electrophotographic imaging member according to claim 12 further comprising a blocking layer interposed between said substrate and said first charge generator layer.

14. An electrophotographic imaging member according to claim 13 further comprising an adhesive layer interposed between said barrier layer and said first charge generator layer.

15. An electrophotographic imaging member according to claim 14 wherein said second generator layer is sensitive to a predetermined region of the light spectrum and said first generator layer is transparent to said region of the light spectrum.

16. An imaging member according to claim 15 wherein said region of the light spectrum is in the infrared region, said second generator layer being sensitive to the visible portion of the light spectrum.

17. An electrophotographic imaging member according to claim 14 wherein said charge transport layer comprises charge transporting monomers dispersed in an inert polymer.

18. An electrophotographic imaging member according to claim 14 wherein said charge transport layer comprises a charge transporting polymer.

19. An electrophotographic imaging member according to claim 14 wherein said substrate comprises an aluminum drum.

20. An electrophotographic imaging member according to claim 14 wherein said substrate is a flexible belt having a transparent conductive coating, said substrate being transparent.

21. An electrophotographic imaging member according to claim 14 wherein the pattern of said second charge generator layer is formed by a plurality of dots.

22. An electrophotographic imaging member according to claim 14, wherein the pattern of said second charge generator layer is formed by a plurality of lines.

23. An electrophotographic imaging member comprising a first charge generator layer having at least one charge generator pigment sensitive to a first waveband region, a second charge generator layer sensitive to a second waveband region and substantially insensitive to said first waveband region, and a charge transport layer, one of said charge generator layers being noncontinuous and forming a predetermined pattern in the plane of said layers.

24. An imaging process for both textual and pictorial reproduction utilizing an imaging member having a first generator layer which is sensitive to a first waveband region and a second generator layer which is sensitive to a second waveband region and substantially transparent to said first waveband region, said process comprising the steps of:

depositing a nonuniform electrostatic charge on said imaging member;

exposing said imaging member from a first direction to radiation of said second waveband region of an image to form an electrostatic latent image on said imaging member;

developing said electrostatic latent image with electrostatically attractable marking particles to form a toner image; and transferring said toner image to a receiving member.

25. The imaging process of claim 24 further comprising the step of pre-exposing said imaging member from a second direction to light of said first waveband region if said image includes non-textual matter.

26. The imaging process of claim 25 wherein said first and second directions are the same.

27. The imaging process of claim 24 wherein said first waveband region is the infrared region and said second waveband region is the visible region.

28. The imaging process of claim 25 wherein said first waveband region is the infrared region and said second waveband region is the visible region.

29. The imaging process of claim 26 wherein said first waveband region is the infrared region and said second waveband region is the visible region.

30. An imaging process for both textual and pictorial reproduction utilizing an imaging member having a first generator layer which is sensitive to a first waveband region and a second generator layer which is sensitive to a second waveband region and substantially transparent to said first waveband region, comprising the steps of:

depositing a uniform electrostatic charge on said imaging member;

pre-exposing said imaging member from a first predetermined direction to light of said first waveband region;

exposing said imaging member from a second direction to radiation of said second waveband region of an image to form an electrostatic latent image on said imaging member;

developing said electrostatic latent image with electrostatically attractable marking particles to form a toner image; and transferring said toner image to a receiving member.

31. The imaging process of claim 30 wherein said first and second predetermined directions are the same.

32. The imaging process of claim 30 wherein said first waveband region is the infrared region and said second waveband region is the visible region.

33. The imaging process of claim 31, wherein said first waveband region is the infrared region and said second waveband region is the visible region.

34. An imaging process for simultaneous textual and pictorial reproduction utilizing an imaging member having a first generator layer which is sensitive to a first waveband region and a second generator layer which is sensitive to a second waveband region and substantially transparent to said first waveband region, comprising the steps of:

depositing a uniform electrostatic charge on said imaging member;

pre-exposing segments of said imaging member from a predetermined direction to light of said first waveband region, said segments corresponding in location to non-textual segments of a composite image to be reproduced;

exposing said imaging member from said direction to radiation of said second waveband region of said composite image to form an electrostatic latent image on said imaging member;

developing said electrostatic latent image with electrostatically attractable marking particles to form a toner image; and transferring said toner image to a receiving member.

35. The imaging process of claim 34 wherein said first waveband region is the infrared region and said second waveband region is the visible region.

* * * * *

UNITED STATES PATENT AND TRADEMARK OFFICE

CERTIFICATE OF CORRECTION

PATENT NO. : 5,230,974

DATED : July 27, 1993

INVENTOR(S) : Damodar M. Pai et al

It is certified that error appears in the above-indentified patent and that said Letters Patent is hereby corrected as shown below:

| Column | Line | |
|---|---|---|
| 1 | 48 | Change "polysillenes" to --polysilines--. |
| 3 | 14 | Change "...). The" to --...), the--. |
| 4 | 33 | Change "an" to --a--. |
| 5 | 24 | Change "in a" to --in an--. |
| 6 | 54 | Change "4-aminob-" to -- 4-amino- --. |
| 6 | 55 | Change "enzens" to --benzene--. |
| 7 | 53 | Change "for" to --from--. |
| 7 | 57 | After "like" insert --,--; change "film forming" to --film-forming--. |
| 8 | 14 | Delete "polyvinylchloride, vinylchlo-". |
| 8 | 15 | Delete "ride and vinyl acetate copolymers," |

UNITED STATES PATENT AND TRADEMARK OFFICE

CERTIFICATE OF CORRECTION

PATENT NO. : 5,230,974

DATED : July 27, 1993

INVENTOR(S) : Damodar M. Pai et al

It is certified that error appears in the above-indentified patent and that said Letters Patent is hereby corrected as shown below:

| Column | Line | |
|---|---|---|
| 9 | 2 | Change "thylamino" to --thylaminophenyl)--. |
| 11 | 36 | Change "vandyl" to --vanadyl--. |
| 12 | 18 | Change "dot" to --dots--. |
| 12 | 35 | Change "dot" to --dots--. |
| 12 | 58 | Change "dot" to --dots--. |
| 14 | 44 | Change "nonuniform" to --uniform--. |

Signed and Sealed this

Fifth Day of April, 1994

Bruce Lehman

BRUCE LEHMAN

*Commissioner of Patents and Trademarks*

*Attest:*

*Attesting Officer*